US011501713B2

(12) United States Patent
Yue et al.

(10) Patent No.: US 11,501,713 B2
(45) Date of Patent: Nov. 15, 2022

(54) PIXEL CIRCUIT, DRIVING METHOD THEREOF AND DISPLAY DEVICE

(71) Applicant: BOE Technology Group Co., Ltd., Beijing (CN)

(72) Inventors: Han Yue, Beijing (CN); Can Zhang, Beijing (CN); Can Wang, Beijing (CN); Minghua Xuan, Beijing (CN)

(73) Assignee: BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 279 days.

(21) Appl. No.: 16/858,170

(22) Filed: Apr. 24, 2020

(65) Prior Publication Data

US 2021/0125558 A1 Apr. 29, 2021

(30) Foreign Application Priority Data

Oct. 29, 2019 (CN) ..... 201911036890.0

(51) Int. Cl.
*G09G 3/3258* (2016.01)
*G09G 3/3291* (2016.01)
(Continued)

(52) U.S. Cl.
CPC ..... *G09G 3/3258* (2013.01); *G09G 3/3291* (2013.01); *G09G 3/325* (2013.01);
(Continued)

(58) Field of Classification Search
CPC .... G09G 3/3258; G09G 3/325; G09G 3/3233; G09G 3/3225; G09G 3/3216; G09G 3/3291
See application file for complete search history.

(56) References Cited

U.S. PATENT DOCUMENTS

2017/0039945 A1* 2/2017 Wang ..... G09G 3/3233
2017/0047002 A1* 2/2017 Xuan ..... G09G 3/32
(Continued)

FOREIGN PATENT DOCUMENTS

CN 101976545 A 2/2011
CN 105679244 A 6/2016
(Continued)

OTHER PUBLICATIONS

Office Action dated Sep. 1, 2020 issued in corresponding Chinese Application No. 201911036890.0.

*Primary Examiner* — William Boddie
*Assistant Examiner* — Saifeldin E Elnafia
(74) *Attorney, Agent, or Firm* — Nath, Goldberg & Meyer; Joshua B. Goldberg

(57) ABSTRACT

The disclosure provides a pixel circuit and a driving method thereof, a display device. The pixel circuit includes: a storage capacitor having a first terminal coupled to a first node and a second terminal coupled to a second node; a light emitting diode having a first electrode coupled to a third node and a second electrode coupled to a second power supply terminal; a data writing circuit configured to write a data voltage into the second node; a compensation circuit configured to write a voltage of the third node, as a compensation voltage, into the first node; a driving transistor having a control terminal coupled to the first node, a first electrode coupled to a first power supply terminal and a second electrode coupled to the light emitting control circuit; a light emitting control circuit configured to control the light emitting diode to emit light.

7 Claims, 2 Drawing Sheets

(51) Int. Cl.

| | |
|---|---|
| *G09G 3/3216* | (2016.01) |
| *G09G 3/325* | (2016.01) |
| *G09G 3/3233* | (2016.01) |
| *G09G 3/3225* | (2016.01) |

(52) U.S. Cl.
CPC ..... *G09G 3/3216* (2013.01); *G09G 3/3225* (2013.01); *G09G 3/3233* (2013.01)

(56) References Cited

U.S. PATENT DOCUMENTS

| | | | | |
|---|---|---|---|---|
| 2017/0270860 | A1* | 9/2017 | Wang | G09G 3/3258 |
| 2018/0102085 | A1* | 4/2018 | Pan | G09G 3/3291 |
| 2018/0102095 | A1* | 4/2018 | Han | G09G 3/3266 |
| 2018/0226027 | A1* | 8/2018 | Wang | G09G 3/3258 |
| 2018/0342205 | A1 | 11/2018 | Wang et al. | |

FOREIGN PATENT DOCUMENTS

| | | | |
|---|---|---|---|
| CN | 108281113 | A | 7/2018 |
| CN | 108682387 | A | 10/2018 |

* cited by examiner

PIXEL CIRCUIT, DRIVING METHOD THEREOF AND DISPLAY DEVICE

CROSS-REFERENCE TO RELATED APPLICATIONS

The present disclosure claims priority to Chinese patent publication No. 201911036890.0, filed on Oct. 29, 2019, the contents of which are incorporated herein by reference.

TECHNICAL FIELD

The disclosure relates to the field of display technology, and particularly relates to a pixel circuit, a driving method thereof and a display device.

BACKGROUND

An organic light-emitting diode (OLED) display panel has advantages of self-luminescence, high contrast, low power consumption, wide viewing angle, fast response speed, and the like, and is widely applied in the display field.

SUMMARY

An embodiment of the present disclosure provides a pixel circuit, including: a storage capacitor, a light emitting diode, a data writing circuit, a compensation circuit, a driving transistor and a light emitting control circuit; a first terminal of the storage capacitor is electrically coupled to a first node, and a second terminal of the storage capacitor is electrically coupled to a second node; a first electrode of the light emitting diode is electrically coupled to a third node, and a second electrode of the light emitting diode is electrically coupled to a second power supply terminal; the data writing circuit is electrically coupled to the second node and is configured to write a data voltage into the second node under the control of a gate control signal; the compensation circuit is electrically coupled to the first node and the third node, and is configured to write a voltage of the third node, as a compensation voltage, into the first node under the control of a compensation control signal provided by a compensation signal terminal, the compensation voltage is a sum of a lighting voltage of the light emitting diode and a voltage of the second power supply terminal; a control terminal of the driving transistor is electrically coupled to the first node, a first electrode of the driving transistor is electrically coupled to a first power supply terminal, and a second electrode of the driving transistor is electrically coupled to the light emitting control circuit; the light emitting control circuit is configured to, under the control of a light emitting control signal, control the light emitting diode to emit light under the driving of the driving transistor.

In some implementations, the pixel circuit further includes a reset circuit electrically coupled to the first node and configured to write an initialization voltage into the first node under the control of a reset signal so as to reset the voltage of the first node.

In some implementations, the data writing circuit includes a first transistor and a second transistor, switching characteristics of the first transistor are opposite to those of the second transistor, and both a first electrode of the first transistor and a first electrode of the second transistor are electrically coupled to a data voltage terminal, both a second electrode of the first transistor and a second electrode of the second transistor are electrically coupled to the second node, a control electrode of the first transistor is electrically coupled to a first gate control signal terminal, a control electrode of the second transistor is electrically coupled to a second gate control signal terminal, and the first transistor and the second transistor write the data voltage into the second node under the control of the first gate control signal terminal and the second gate signal terminal.

In some implementations, the reset circuit includes a third transistor, a first electrode of the third transistor is electrically coupled to an initialization voltage terminal, a second electrode of the third transistor is electrically coupled to the first node, and a control electrode of the third transistor is electrically coupled to a reset signal terminal.

In some implementations, the compensation circuit includes a fourth transistor, a first electrode of the fourth transistor is electrically coupled to the third node, a second electrode of the fourth transistor is electrically coupled to the first node, and a control electrode of the fourth transistor is electrically coupled to the compensation control signal terminal.

In some implementations, the light emitting control circuit includes a fifth transistor and a sixth transistor, a first electrode of the fifth transistor is electrically coupled to the second electrode of the driving transistor, a second electrode of the fifth transistor is electrically coupled to the third node, and a control electrode of the fifth transistor is electrically coupled to a light emitting control signal terminal; a first electrode of the sixth transistor is electrically coupled to a common electrode terminal, a second electrode of the sixth transistor is electrically coupled to the second node, and a control electrode of the sixth transistor is electrically coupled to the light emitting control signal terminal.

In some implementations, a difference between the initialization voltage and the voltage of the second power supply terminal is larger than the lighting voltage of the light emitting diode.

An embodiment of the present disclosure further provides a pixel circuit, including a storage capacitor, a light emitting diode, a driving transistor, a first transistor, a second transistor, a third transistor, a fourth transistor, a fifth transistor and a sixth transistor, switching characteristics of the first transistor are opposite to those of the second transistor; a first terminal of the storage capacitor is electrically coupled to a first node, and a second terminal of the storage capacitor is electrically coupled to a second node; a first electrode of the light emitting diode is electrically coupled to a third node, and a second electrode of the light emitting diode is electrically coupled to a second power supply terminal; a first electrode of the driving transistor is electrically coupled to a first power supply terminal, a second electrode of the driving transistor is electrically coupled to a first electrode of the fifth transistor, and a control electrode of the driving transistor is electrically coupled to the first node; both a first electrode of the first transistor and a first electrode of the second transistor are electrically coupled to a data voltage terminal, both a second electrode of the first transistor and a second electrode of the second transistor are electrically coupled to the second node, a control electrode of the first transistor is electrically coupled to a first gate control signal terminal, and a control electrode of the second transistor is electrically coupled to a second gate control signal terminal; a first electrode of the third transistor is electrically coupled to an initialization voltage terminal, a second electrode of the third transistor is electrically coupled to the first node, and a control electrode of the third transistor is electrically coupled to a reset signal terminal; a first electrode of the fourth transistor is electrically coupled to the third node, a second electrode of the fourth transistor is electrically coupled to the first node, and a control electrode of the fourth transistor is electrically coupled to a compensation control signal terminal; the first electrode of the fifth transistor is electrically coupled to the second electrode of the driving transistor, a second electrode of the fifth transistor is electrically coupled to the third node, and a control electrode of the fifth transistor is electrically coupled to a light emitting control signal terminal; a first electrode of the sixth transistor is electrically coupled to a common electrode terminal, a second electrode of the sixth transistor is electrically coupled to the second node, and a control electrode of the sixth transistor is electrically coupled to the light emitting control signal terminal.

In some implementations, in a reset stage, the first transistor, the second transistor, and the third transistor are configured to be turned on, and the fourth transistor, the fifth transistor, the sixth transistor, and the driving transistor are configured to be turned off, so that a voltage of the first node is equal to Vinit and a voltage of the second node is equal to Vdata, Vinit is an initialization voltage, Vdata is a data voltage; in a compensation stage, the first transistor, the second transistor and the fourth transistor are configured to be turned on, and the third transistor, the fifth transistor, the sixth transistor and the driving transistor are configured to be turned off, so that the voltage of the first node is equal to Vf+V0, the voltage of the second node is equal to Vdata and the voltage of the third node is equal to Vf+V0, Vf is the lighting voltage of the light emitting diode, and V0 is a voltage of the second power supply terminal; in a light emitting stage, the driving transistor, the fifth transistor and the sixth transistor are configured to be turned on, and the first transistor, the second transistor, the third transistor and the fourth transistor are configured to be turned off, so that the voltage of the first node is equal to Vcom−Vdata+Vf+V0, the voltage of the second node is equal to Vcom, and the voltage of the third node is equal to Vcom−Vdata+Vf+V0−Vth, Vcom is a common voltage, and Vth is a threshold voltage of the driving transistor.

In some implementations, the first transistor, the second transistor, the third transistor, the fourth transistor, the fifth transistor, the sixth transistor, and the driving transistor each include a field effect transistor.

An embodiment of the present disclosure further provides a driving method for driving the pixel circuit described above, including a compensation stage and a light emitting stage, in the compensation stage, controlling the data writing circuit to be turned on by using the gate control signal so as to write the data voltage into the second node; controlling the compensation circuit to be turned on by using the compensation signal so as to write the voltage of the third node, as the compensation voltage, into the first node, the compensation voltage is the sum of the lighting voltage of the light emitting diode and the voltage of the second power supply terminal; and in the light emitting stage, controlling the data writing circuit to be turned off by using the gate control signal, controlling the compensation circuit to be turned off by using the compensation signal, controlling the driving transistor to be turned on by using the voltage of the first node, and controlling the light emitting control circuit to be turned on by using the light emitting control signal so as to drive the light emitting diode to emit light.

In some implementations, the pixel circuit further includes a reset circuit electrically coupled to the first node, and configured to write an initialization voltage into the first node under the control of a reset signal, to reset the voltage of the first node, the driving method further including a reset stage, where, in the reset stage, controlling the compensation circuit, the driving transistor and the light emitting control circuit to be turned off, controlling the data writing circuit to be turned on by the gate control signal to write the data voltage into the second node, and controlling the reset circuit to be turned on by using a reset control signal to reset the voltage of the first node.

An embodiment of the present disclosure further provides a driving method for driving the pixel circuit described above, including a reset stage, a compensation stage and a light emitting stage, in the reset stage, controlling the first transistor, the second transistor and the third transistor to be turned on, controlling the fourth transistor, the fifth transistor, the sixth transistor and the driving transistor to be turned off, the voltage of the first node is reset to Vinit, and the voltage of the second node is equal to Vdata; where, Vinit is the initialization voltage, and Vdata is the data voltage; in the compensation stage, controlling the first transistor, the second transistor and the fourth transistor to be turned on, and controlling the third transistor, the fifth transistor, the sixth transistor and the driving transistor to be turned off, so that the voltage of the first node is equal to Vf+V0, the voltage of the second node is equal to Vdata and the voltage of the third node is equal to Vf+V0; Vf is the lighting voltage of the light emitting diode, and V0 is the voltage of the second power supply terminal; in the light emitting stage, controlling the driving transistor, the fifth transistor and the sixth transistor to be turned on, and controlling the first transistor, the second transistor, the third transistor and the fourth transistor to be turned off, so that the voltage of the first node is equal to Vcom−Vdata+Vf+V0, the voltage of the second node is equal to Vcom, and the voltage of the third node is equal to Vcom−Vdata+Vf+V0−Vth; Vcom is the common voltage, and Vth is a threshold voltage of the driving transistor.

An embodiment of the present disclosure further provides a display device, including any pixel circuit described above.

In some implementations, the pixel circuit is integrated on a silicon substrate.

In some implementations, the display device includes a virtual reality display device or an augmented reality display device.

DESCRIPTION OF EMBODIMENTS

In order that those skilled in the art will better understand the technical solutions of the present disclosure, the following detailed description is given with reference to the accompanying drawings and the specific embodiments.

In the related art, display brightness of an OLED display panel is controlled by controlling a voltage across a light emitting diode, however, during usage of the OLED display, due to differences in material, process and attenuation of light emitting diodes, efficiencies of the light emitting diodes are likely to be different, that is, the light emitting diodes exhibit different brightness under a same voltage across two terminals thereof, and finally, brightness non-uniformity and chromaticity non-uniformity of the display panel are likely to be caused. In particular, for the light emitting diodes, such non-uniformities are mainly manifested as a difference in lighting voltage at which the light emitting diode starts to emit light.

Therefore, the present disclosure provides a pixel circuit and a driving method thereof and a display device to solve the above technical problems.

In an embodiment of the present disclosure, a source and a drain of each transistor may be interchanged under a certain condition, and thus, the source and the drain of each transistor are not distinguished from each other in the description of the electrical connection relationship. In embodiments of the present disclosure, in order to distinguish the source and the drain of the transistor, one of the source and the drain is referred to as a first electrode, the other one of the source and the drain is referred to as a second electrode, and a gate of the transistor is referred to as a control electrode. In addition, the transistors can be divided into N-type transistors and P-type transistors according to the characteristics of the transistors, for an N-type transistor, the first electrode is the source of the N-type transistor, the second electrode is the drain of the N-type transistor, and when the gate is input with a high level, the source and the drain are electrically coupled, and the opposite is true for a P-type transistor. In order to make those skilled in the art better understand the technical solutions of the present disclosure, a pixel circuit and a driving method thereof and a display device provided by the present disclosure will be described in detail below with reference to the accompanying drawings and the specific embodiments.

Figure 1:
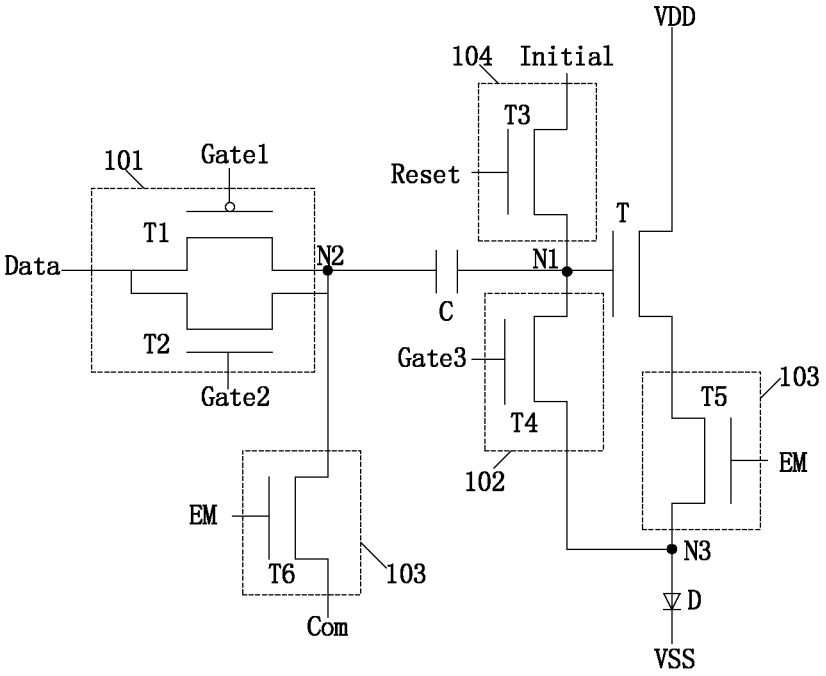
FIG. 1 and FIG. 2 are schematic structural diagrams of a pixel circuit according to an embodiment of the present disclosure.

FIG. 1 is a schematic structural diagram of a pixel circuit according to an embodiment of the present disclosure, and as shown in FIG. 1, the pixel circuit includes: a storage capacitor C, a light emitting diode D, a data writing circuit 101, a compensation circuit 102, a driving transistor T, and a light-emitting control circuit 103.

The storage capacitor C has a first terminal electrically coupled to a first node N1 and a second terminal electrically coupled to a second node N2. A first electrode of the light emitting diode D is electrically coupled to a third node N3, and a second electrode of the light emitting diode D is electrically coupled to a second power supply terminal VSS. The data writing circuit 101 is configured to write a data voltage into the second node N2 under the control of a gate control signal. The compensation circuit 102 is configured to write a voltage of the third node N3 as a compensation voltage into the first node N1 under the control of a compensation control signal; the compensation voltage is a sum of the lighting voltage of the light emitting diode D and the voltage of the second power supply terminal VSS. The light-emitting control circuit 103 is configured to control the driving transistor T to drive the light-emitting diode D to emit light under the control of a light-emitting control signal.

In the pixel circuit provided by the embodiment of the disclosure, in a compensation stage, the data writing circuit 101 may write the data voltage Vdata into the second node N2 under the control of the gate control signal, and the voltage of the second node N2 is the data voltage Vdata. Meanwhile, the compensation circuit 102 may directly write the voltage of the third node N3, electrically coupled to the first electrode, i.e., the anode, of the light emitting diode D, as a compensation voltage into the first node N1, electrically coupled to the first terminal of the storage capacitor C, at this time, the voltage of the first node N1 is equal to the voltage of the third node N3, which is the sum of the lighting voltage Vf of the light emitting diode D and the voltage V0 of the second power supply terminal VSS, i.e., Vf+V0. In a light emitting stage, the light-emitting control circuit 103 starts to operate, and the light emitting diode D can emit light under the driving of the driving transistor T. At this time, the second node N2, electrically coupled to one terminal of the storage capacitor C, is electrically coupled to a common electrode terminal Com, and the voltage of the second node N2 is equal to Vcom. According to the bootstrap principle of the capacitor, the voltage of the first node N1 is equal to Vcom-Vdata+Vf+V0. At this time, the voltage of the third node N3, electrically coupled to the anode of the light emitting diode D, is equal to Vcom−Vdata+Vf+V0−Vth, Vth represents a threshold voltage of the driving transistor T, and the voltage of the second electrode, i.e. the cathode, of the light emitting diode D is equal to the voltage V0 of the second power supply terminal VSS. Therefore, the voltage U across the two electrodes of the light emitting diode D is equal to Vcom−Vdata+Vf+V0−Vth-V0, i.e. Vcom−Vdata+Vf−Vth, and a voltage difference ΔU between the voltage U and the lighting voltage Vf of the light emitting diode D is equal to Vcom−Vdata+Vf−Vth−Vf, i.e. ΔU=Vcom−Vdata−Vth. Since the light emitting luminance of the light emitting diode D is only associated with ΔU, it can be seen from the above expression of ΔU that, in the embodiment of the present disclosure, the light-emitting luminance of the light emitting diode D in the light emitting stage is only associated with the data voltage Vdata, and is not associated with the lighting voltage Vf. Therefore, the pixel circuit provided by the embodiment of the disclosure can eliminate the influence of the lighting voltage Vf on the display, and suppress the non-uniformity of lighting voltages Vf, so that the uniformity of the display can be improved, and the display effect can be improved.

It should be noted that the second power supply terminal VSS electrically coupled to the cathode of the light emitting diode D may be a ground terminal GND, so as to ensure that the cathode of the light emitting diode D has a lower voltage, and the cathode of the light emitting diode D being directly electrically coupled to the ground terminal GND may facilitate wiring and reduce wiring difficulty.

In some implementations, as shown in FIG. 1, the pixel circuit provided by the embodiments of the present disclosure further includes a reset circuit 104. The reset circuit 104 is configured to write an initialization voltage Vinit into the first node N1 under the control of a reset signal to reset the voltage of the first node N1.

It should be noted that, the pixel circuit provided in the embodiment of the present disclosure needs to reset the voltage of the first node N1, i.e., a reset stage is required, before the compensation stage and the light emitting stage. In the reset stage, the reset circuit 104 may write the initialization voltage Vinit into the first node N1 under the control of a reset signal, thereby implementing the reset of the voltage of the first node N1. Meanwhile, the data writing circuit 101 may write the data voltage Vdata into the second node N2 under the control of the gate control signal, where the voltage of the first node N1 electrically coupled to the first terminal of the storage capacitor C is equal to Vinit, and the voltage of the second node N2 electrically coupled to the second terminal of the storage capacitor C is equal to Vdata.

Based on the pixel circuit provided above, functional circuits in the pixel circuit will be further described in detail below with reference to the accompanying drawings.

In some implementations, as shown in FIG. 1, the data writing circuit 101 may include a first transistor T1 and a second transistor T2, the switching characteristics of the first transistor T1 are opposite to those of the second transistor T2. A source of the first transistor T1 is electrically coupled to a source of the second transistor T2 and electrically coupled to the data voltage terminal Data, a drain of the first transistor T1 is electrically coupled to a drain of the second transistor T2 and electrically coupled to the second node N2, a gate of the first transistor T1 is electrically coupled to the a first gate control signal terminal Gate1, and a gate of the second transistor T2 is electrically coupled to a second gate control signal terminal Gate 2.

It should be noted that the first transistor T1 and the second transistor T2 may be complementary transistors, and the switching characteristics of these two transistors are opposite. In the embodiment of the present disclosure, description is given by taking the first transistor T1 being a P-type transistor, the second transistor T2 being an N-type transistor, and the other transistors being N-type transistors as an example. Certainly, the transistors may be transistors with other characteristics, and are not limited herein. In the reset stage, the first transistor T1 is turned on under the control of a low-level control signal provided by the first gate control signal terminal Gate1, the second transistor T2 is turned on under the control of a high-level control signal provided by the second gate control signal terminal Gate2, and the data voltage Vdata may be written into the second node N2 electrically coupled to the second terminal of the storage capacitor C, where the voltage of the second node N2 is equal to Vdata. In the compensation stage, the first transistor T1 and the second transistor T2 are also controlled in a same manner, so that the voltage of the second node N2 is kept at Vdata, and the specific implementation process is the same as that in the reset stage, which is not described herein again.

In some implementations, as shown in FIG. 1, the reset circuit 104 may include a third transistor T3. The third transistor T3 has a source electrically coupled to an initialization voltage terminal Initial, a drain electrically coupled to the first node N1, and a gate electrically coupled to a reset signal terminal Reset.

It should be noted that, in the reset stage, the third transistor T3 is turned on under the control of a high-level control signal provided by the reset signal terminal Reset, and an initialization voltage Vinit may be written into the first node N1 electrically coupled to the first terminal of the storage capacitor C, at this time, the voltage of the first node N1 is equal to Vinit, thereby implementing the reset of the voltage of the first node N1 electrically coupled to the first terminal of the storage capacitor C.

In some implementations, as shown in FIG. 1, the compensation circuit 102 may include a fourth transistor T4. The fourth transistor T4 has a source electrically coupled to the third node N3, a drain electrically coupled to the first node N1, and a gate electrically coupled to a compensation control signal terminal Gate 3.

It should be noted that, in the compensation stage, the fourth transistor T4 is turned on under the control of a high-level control signal provided by the compensation control signal terminal Gate3, an initial state of the light emitting diode D is activated, and discharge through the light emitting diode D is caused until a voltage difference across the light emitting diode D is equal to the lighting voltage Vf, and the discharge is ended. At this time, the voltage of the third node N3 may be written into the first node N1, and the voltage of the first node N1 is maintained as the sum of the lighting voltage Vf of the light emitting diode D and voltage V0 of the second power supply terminal VSS, that is, Vf+V0, thereby achieving compensation of the voltage of the first node N1 electrically coupled to the first terminal of the storage capacitor C.

In some implementations, as shown in FIG. 1, the light emitting control circuit 103 may include a fifth transistor T5 and a sixth transistor T6. A source of the fifth transistor T5 is electrically coupled to the drain of the driving transistor T, a drain of the fifth transistor T5 is electrically coupled to the third node N3, and a gate of the fifth transistor T5 is electrically coupled to the light emitting control signal terminal EM; a source of the sixth transistor T6 is electrically coupled to the common electrode terminal Com, a drain of the sixth transistor T6 is electrically coupled to the second node N2, and a gate of the sixth transistor T6 is electrically coupled to the light emitting control signal terminal EM.

It should be noted that, in the light emitting stage, the sixth transistor T6 may also be turned on under the control of a high-level signal provided by the light emitting control signal terminal EM, and a voltage Vcom of the common electrode terminal Com can be written into the second node N2. According to the capacitor bootstrap principle, the voltage of the first node N1 is equal to Vcom−Vdata+Vf+V0. At this time, the fifth transistor T5 may be turned on under the control of a high-level signal provided by the light emitting control signal terminal EM, and the light emitting diode D may emit light under the driving of the driving transistor T. The voltage of the third node N3 electrically coupled to the anode of the light emitting diode D is equal to Vcom−Vdata+Vf+V0−Vth, and the voltage of the cathode of the light emitting diode D is equal to the voltage V0 of the second power supply terminal VSS. Therefore, the voltage U across the two terminals of the light emitting diode D is equal to Vcom−Vdata+Vf+V0−Vth-V0, i.e. Vcom−Vdata+Vf−Vth, and a voltage difference ΔU between the voltage U and the lighting voltage Vf of the light emitting diode D is equal to Vcom−Vdata+Vf−Vth−Vf, i.e. ΔU=Vcom−Vdata−Vth. Since the light-emitting luminance of the light emitting diode D is only associated with ΔU, it can be seen from the above expression of ΔU that, in the embodiment of the present disclosure, the light-emitting luminance of the light emitting diode D in the light emitting stage is only associated with the data voltage Vdata, and is not associated with the lighting voltage Vf.

In some implementations, a difference between the initializing voltage Vinit and the voltage V0 of the second power supply terminal VSS is greater than the lighting voltage Vf of the light emitting diode D.

It should be noted that the difference between the initialization voltage Vinit and the voltage V0 of the second power supply terminal VSS is greater than the lighting voltage Vf of the light emitting diode D. In the reset stage, the voltage of the first node N1 is less than the voltage of the third node N3, so that a current flowing direction can be ensured, and the voltage of the third node N3 as the compensation voltage can be written into the first node N1 in the compensation stage.

In some implementations, the driving transistor T may be an N-type transistor.

It should be noted that the source and the drain of the N-type transistor may be electrically coupled in response to that the gate of the N-type transistor is provided with a high level voltage, so as to drive the light emitting diode D to emit light. It should be understood that the driving transistor T may also be a transistor with other characteristics, and is not limited herein.

Figure 2:
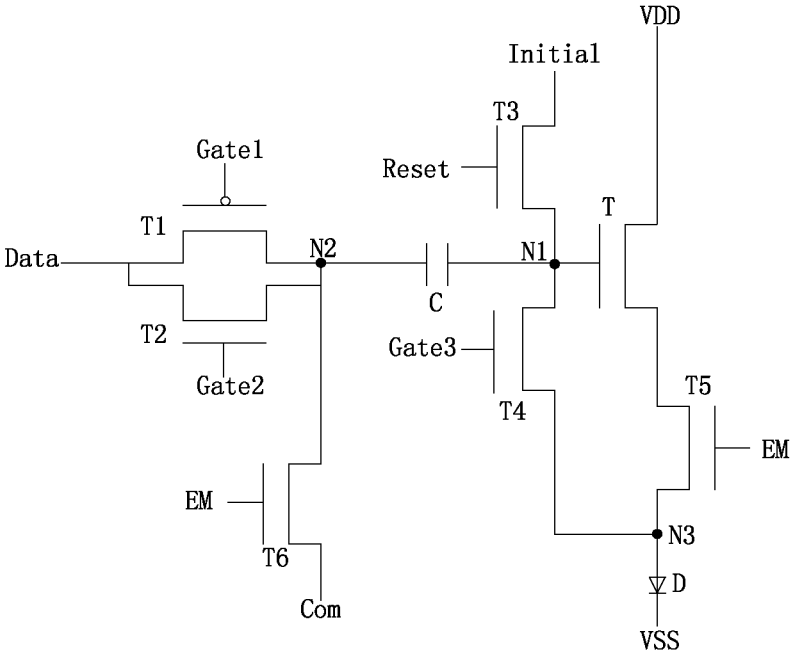

FIG. 2 is a schematic structural diagram of a pixel circuit according to an embodiment of the disclosure, and as shown in FIG. 2, the pixel circuit includes: a storage capacitor C, a light emitting diode D, a driving transistor T, a first transistor T1, a second transistor T2, a third transistor T3, a fourth transistor T4, a fifth transistor T5 and a sixth transistor T6, the switching characteristics of the first transistor T1 are opposite to those of the second transistor T2.

A first terminal of the storage capacitor C is electrically coupled to a first node N1, and a second terminal of the storage capacitor C is electrically coupled to a second node N2. A first electrode of the light emitting diode D is electrically coupled to a third node N3, and a second electrode of the light emitting diode D is electrically coupled to a second power supply terminal VSS. The driving transistor T has a source electrically coupled to a first power supply terminal VDD, a drain electrically coupled to a source of the fifth transistor T5, and a gate electrically coupled to a first node N1. A source of the first transistor T1 and a source of the second transistor T2 are electrically coupled together and electrically coupled to a data voltage terminal Data, a drain of the first transistor T1 and a drain of the second transistor T2 are electrically coupled together and electrically coupled to the second node N2, and a gate of the first transistor T1 is electrically coupled to a first gate control signal terminal Gate1, and a gate of the second transistor T2 is electrically coupled to a second gate control signal terminal Gate 2. The third transistor T3 has a source electrically coupled to an initialization voltage terminal Initial, a drain electrically coupled to the first node N1, and a gate electrically coupled to a reset signal terminal Reset. The fourth transistor T4 has a source electrically coupled to the third node N3, a drain electrically coupled to the first node N1, and a gate electrically coupled to a compensation control signal terminal Gate3. The fifth transistor T5 has a source electrically coupled to the drain of the driving transistor T, a drain electrically coupled to the third node N3, and a gate electrically coupled to the light emitting control signal terminal EM. The sixth transistor T6 has a source electrically coupled to a common electrode terminal Com, a drain electrically coupled to the second node N2, and a gate electrically coupled to the light emitting control signal terminal EM.

Figure 3:
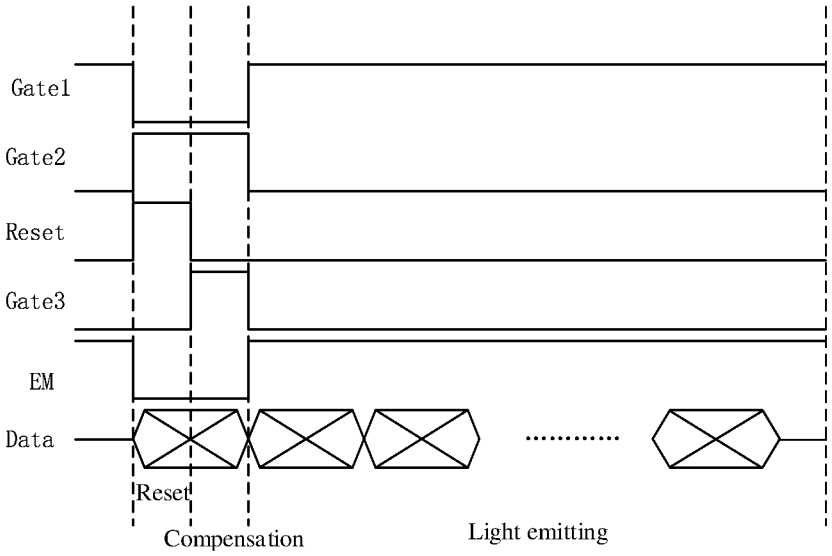
FIG. 3 is a timing diagram of a pixel circuit according to an embodiment of the present disclosure.

The implementation principle of the pixel circuit provided by the embodiment of the present disclosure will be described in detail with reference to FIG. 3.

In a reset stage, the first transistor T1 is turned on under the control of a low-level control signal provided by the first gate control signal terminal Gate1, the second transistor T2 is turned on under the control of a high-level control signal provided by the second gate control signal terminal Gate2, and the data voltage Vdata can be written into the second node N2 electrically coupled to the second terminal of the storage capacitor C, at this time, the voltage of the second node N2 is equal to Vdata. The third transistor T3 is turned on under the control of a high-level control signal provided by the reset signal terminal Reset, and an initialization voltage Vinit can be written into the first node N1 electrically coupled to the first terminal of the storage capacitor C, at this time, the voltage of the first node N1 is equal to Vinit, thereby implementing the reset of the voltage of the first node N1 electrically coupled to the first terminal of the storage capacitor C.

In a compensation stage, the fourth transistor T4 is turned on under the control of a high-level control signal provided by the compensation control signal terminal Gate3, light emitting diode D is in an initial state, and discharge is caused through the light emitting diode D until a voltage difference across the light emitting diode D is equal to a lighting voltage Vf, and then the discharge is ended. At this time, the voltage of the third node N3 can be written into the first node N1, and the voltage of the first node N1 is maintained as the sum of the lighting voltage Vf of the light emitting diode D and a voltage V0 of the second power supply terminal VSS, that is, Vf+V0, thereby achieving compensation of the voltage of the first node N1 electrically coupled to the first terminal of the storage capacitor C.

In a light emitting stage, the sixth transistor T6 may be turned on under the control of a high-level signal provided by the light emitting control signal terminal EM, and a voltage Vcom of the common electrode terminal Com can be written into the second node N2. According to the bootstrap principle of the capacitor, the voltage of the first node N1 is equal to Vcom−Vdata+Vf+V0. At this time, the fifth transistor T5 may be turned on under the control of a high-level signal provided by the light emitting control signal terminal EM, and the light emitting diode D may emit light under the driving of the driving transistor T. A voltage of the third node N3 electrically coupled to the anode of the light emitting diode D is equal to Vcom−Vdata+Vf+V0−Vth, and a voltage of the cathode of the light emitting diode D is equal to the voltage V0 of the second power supply terminal VSS. Therefore, a voltage U across the two terminals of the light emitting diode D is equal to Vcom−Vdata+Vf+V0−Vth-V0, i.e. Vcom−Vdata+Vf−Vth, and a voltage difference ΔU between the voltage U and the lighting voltage Vf of the light emitting diode D is equal to Vcom−Vdata+Vf−Vth−Vf, i.e. ΔU=Vcom−Vdata−Vth. Since the light-emitting luminance of the light emitting diode D is only associated with ΔU, it can be seen from the above expression of ΔU that, in the embodiment of the present disclosure, the light-emitting luminance of the light emitting diode D in the light emitting stage is only associated with the data voltage Vdata, and is not associated with the lighting voltage Vf. Therefore, the pixel circuit provided by the embodiment of the present disclosure can eliminate the influence of the lighting voltage Vf on the display, and suppress the non-uniformity of the lighting voltage Vf, so that the uniformity of the display can be improved, and the display effect can be improved.

In some implementations, the first transistor T1, the second transistor T2, the third transistor T3, the fourth transistor T4, the fifth transistor T5, the sixth transistor T6, and the driving transistor T each include a field effect transistor.

It should be noted that the field effect transistor can reduce the volume of each functional circuit, which is beneficial to improving the pixel resolution of the display, thereby achieving a better display effect.

An embodiment of the present disclosure provides a driving method applied to the pixel circuit shown in FIG. 1, the driving method includes a reset stage, a compensation stage, and a light emitting stage, wherein:

in the reset stage, controlling the compensation circuit, the driving transistor and the light emitting control circuit to be turned off, controlling the data writing circuit to be turned on by using a gate control signal to write the data voltage into the second node, and controlling the reset circuit to be turned on by using the reset control signal to reset the voltage of the first node;

in the compensation stage, controlling the data writing circuit to be turned on by using the gate control signal so as to write the data voltage into the second node; controlling the compensation circuit to be turned on by using the compensation signal so as to write the voltage of the third node, as the compensation voltage, into the first node, where the compensation voltage is the sum of the lighting voltage of the light emitting diode and the voltage of the second power supply terminal; and in the light emitting stage, controlling the data writing circuit to be turned off by using the gate control signal, controlling the compensation circuit to be turned off by using the compensation signal, controlling the driving transistor to be turned on by using the voltage of the first node, and controlling the light emitting control circuit to be turned on by using the light emitting control signal so as to drive the light emitting diode to emit light.

An embodiment of the present disclosure provides a driving method applied to the pixel circuit shown in FIG. 2, the driving method includes a reset stage, a compensation stage, and a light emitting stage, wherein:

in a reset stage, controlling the first transistor, the second transistor and the third transistor to be turned on, controlling the fourth transistor, the fifth transistor, the sixth transistor and the driving transistor to be turned off, the voltage of the first node is reset to Vinit, and the voltage of the second node is equal to Vdata; where, Vinit is the initialization voltage, and Vdata is the data voltage;

in the compensation stage, controlling the first transistor, the second transistor and the fourth transistor to be turned on, and controlling the third transistor, the fifth transistor, the sixth transistor and the driving transistor to be turned off, so that the voltage of the first node is equal to Vf+V0, the voltage of the second node is equal to Vdata and the voltage of the third node is equal to Vf+V0; where Vf is the lighting voltage of the light emitting diode, and V0 is the voltage of the second power supply terminal;

in the light emitting stage, controlling the driving transistor, the fifth transistor and the sixth transistor to be turned on, and controlling the first transistor, the second transistor, the third transistor and the fourth transistor to be turned off, so that the voltage of the first node is equal to Vcom−Vdata+Vf+V0, the voltage of the second node is equal to Vcom, and the voltage of the third node is equal to Vcom−Vdata+Vf+V0−Vth; where Vcom is the common voltage, and Vth is a threshold voltage of the driving transistor.

Based on the same inventive concept, an embodiment of the present disclosure provides a display device including the pixel circuit provided in the above embodiment. The pixel circuit provided by the above embodiment may be integrated on a silicon substrate. The display device provided by the embodiment of the present disclosure may be a virtual display device, may also be an augmented reality display device, and certainly, may also be a display device having other functions, which are not listed one by one here. It can be understood that the implementation principle of the display device provided by the embodiment of the present disclosure is the same as that of the pixel circuit provided by the above embodiment, and is not described herein again.

It will be understood that the above embodiments are merely exemplary embodiments employed to illustrate the principles of the present disclosure, and the present disclosure is not limited thereto. It will be apparent to those skilled in the art that various changes and modifications can be made therein without departing from the spirit and scope of the disclosure, and these changes and modifications are to be considered within the scope of the disclosure.

What is claimed is:

1. A pixel circuit, comprising a storage capacitor, a light emitting diode, a driving transistor, a first transistor, a second transistor, a third transistor, a fourth transistor, a fifth transistor and a sixth transistor, wherein switching characteristics of the first transistor are opposite to those of the second transistor;

a first terminal of the storage capacitor is electrically coupled to a first node, and a second terminal of the storage capacitor is electrically coupled to a second node;

a first electrode of the light emitting diode is electrically coupled to a third node, and a second electrode of the light emitting diode is electrically coupled to a second power supply terminal;

a first electrode of the driving transistor is electrically coupled to a first power supply terminal, a second electrode of the driving transistor is electrically coupled to a first electrode of the fifth transistor, and a control electrode of the driving transistor is electrically coupled to the first node;

both a first electrode of the first transistor and a first electrode of the second transistor are electrically coupled to a data voltage terminal, both a second electrode of the first transistor and a second electrode of the second transistor are electrically coupled to the second node, a control electrode of the first transistor is electrically coupled to a first gate control signal terminal, and a control electrode of the second transistor is electrically coupled to a second gate control signal terminal;

a first electrode of the third transistor is electrically coupled to an initialization voltage terminal, a second electrode of the third transistor is electrically coupled to the first node, and a control electrode of the third transistor is electrically coupled to a reset signal terminal;

a first electrode of the fourth transistor is electrically coupled to the third node, a second electrode of the fourth transistor is electrically coupled to the first node, and a control electrode of the fourth transistor is electrically coupled to a compensation control signal terminal;

a first electrode of the fifth transistor is electrically coupled to the second electrode of the driving transistor, a second electrode of the fifth transistor is electrically coupled to the third node, and a control electrode of the fifth transistor is electrically coupled to a light emitting control signal terminal;

a first electrode of the sixth transistor is electrically coupled to a common electrode terminal, a second electrode of the sixth transistor is electrically coupled to the second node, and a control electrode of the sixth transistor is electrically coupled to the light emitting control signal terminal, wherein in a reset stage, the first transistor, the second transistor, and the third transistor are configured to be turned on, and the fourth transistor, the fifth transistor, the sixth transistor, and the driving transistor are configured to be turned off, so that a voltage of the first node is equal to Vinit and a voltage of the second node is equal to Vdata, wherein, Vinit is an initialization voltage, Vdata is a data voltage;

in a compensation stage, the first transistor, the second transistor and the fourth transistor are configured to be turned on, and the third transistor, the fifth transistor, the sixth transistor and the driving transistor are configured to be turned off, so that the voltage of the first node is equal to Vf+V0, the voltage of the second node is equal to Vdata and the voltage of the third node is equal to Vf+V0, wherein Vf is the lighting voltage of the light emitting diode, and V0 is a voltage of the second power supply terminal;

in a light emitting stage, the driving transistor, the fifth transistor and the sixth transistor are configured to be turned on, and the first transistor, the second transistor, the third transistor and the fourth transistor are configured to be turned off, so that the voltage of the first node is equal to Vcom−Vdata+Vf+V0, the voltage of the second node is equal to Vcom, and the voltage of the third node is equal to Vcom−Vdata+Vf+V0−Vth, wherein Vcom is a common voltage, and Vth is a threshold voltage of the driving transistor.

2. The pixel circuit according to claim 1, wherein the first transistor, the second transistor, the third transistor, the fourth transistor, the fifth transistor, the sixth transistor, and the driving transistor each comprise a field effect transistor.

3. A display device, comprising the pixel circuit of claim 1.

4. The display device of claim 3, wherein the pixel circuit is integrated on a silicon substrate.

5. The display device of claim 3, wherein the display device comprises a virtual reality display device or an augmented reality display device.

6. A driving method for driving a pixel circuit, wherein the pixel circuit comprises: a storage capacitor, a light emitting diode, a data writing circuit, a compensation circuit, a driving transistor, a light emitting control circuit and a reset circuit; a first terminal of the storage capacitor is electrically coupled to a first node, and a second terminal of the storage capacitor is electrically coupled to a second node; a first electrode of the light emitting diode is electrically coupled to a third node, and a second electrode of the light emitting diode is electrically coupled to a second power supply terminal; the data writing circuit is electrically coupled to the second node and is configured to write a data voltage into the second node under the control of a gate control signal; the compensation circuit is electrically coupled to the first node and the third node, and is configured to write a voltage of the third node, as a compensation voltage, into the first node under the control of a compensation control signal provided by a compensation signal terminal, wherein the compensation voltage is a sum of a lighting voltage of the light emitting diode and a voltage of the second power supply terminal; a control terminal of the driving transistor is electrically coupled to the first node, a first electrode of the driving transistor is electrically coupled to a first power supply terminal, and a second electrode of the driving transistor is electrically coupled to the light emitting control circuit; the light emitting control circuit is configured to, under the control of a light emitting control signal, control the light emitting diode to emit light under the driving of the driving transistor; and the reset circuit electrically coupled to the first node, and configured to write an initialization voltage into the first node under the control of a reset signal to reset the voltage of the first node, and wherein the driving method comprises a compensation stage, a light emitting stage and a reset stage, wherein in the compensation stage, controlling the data writing circuit to be turned on by using the gate control signal so as to write the data voltage into the second node; controlling the compensation circuit to be turned on by using the compensation signal so as to write the voltage of the third node, as the compensation voltage, into the first node, wherein the compensation voltage is the sum of the lighting voltage of the light emitting diode and the voltage of the second power supply terminal;

in the light emitting stage, controlling the data writing circuit to be turned off by using the gate control signal, controlling the compensation circuit to be turned off by using the compensation signal, controlling the driving transistor to be turned on by using the voltage of the first node, and controlling the light emitting control circuit to be turned on by using the light emitting control signal so as to drive the light emitting diode to emit light, and in the reset stage, controlling the compensation circuit, the driving transistor and the light emitting control circuit to be turned off, controlling the data writing circuit to be turned on by the gate control signal to write the data voltage into the second node, and controlling the reset circuit to be turned on by using a reset control signal to reset the voltage of the first node.

7. A driving method for driving a pixel circuit, wherein the pixel circuit comprises a storage capacitor, a light emitting diode, a driving transistor, a first transistor, a second transistor, a third transistor, a fourth transistor, a fifth transistor and a sixth transistor, wherein switching characteristics of the first transistor are opposite to those of the second transistor; a first terminal of the storage capacitor is electrically coupled to a first node, and a second terminal of the storage capacitor is electrically coupled to a second node; a first electrode of the light emitting diode is electrically coupled to a third node, and a second electrode of the light emitting diode is electrically coupled to a second power supply terminal; a first electrode of the driving transistor is electrically coupled to a first power supply terminal, a second electrode of the driving transistor is electrically coupled to a first electrode of the fifth transistor, and a control electrode of the driving transistor is electrically coupled to the first node; both a first electrode of the first transistor and a first electrode of the second transistor are electrically coupled to a data voltage terminal, both a second electrode of the first transistor and a second electrode of the second transistor are electrically coupled to the second node, a control electrode of the first transistor is electrically coupled to a first gate control signal terminal, and a control electrode of the second transistor is electrically coupled to a second gate control signal terminal; a first electrode of the third transistor is electrically coupled to an initialization voltage terminal, a second electrode of the third transistor is electrically coupled to the first node, and a control electrode of the third transistor is electrically coupled to a reset signal terminal; a first electrode of the fourth transistor is electrically coupled to the third node, a second electrode of the fourth transistor is electrically coupled to the first node, and a control electrode of the fourth transistor is electrically coupled to a compensation control signal terminal; a first electrode of the fifth transistor is electrically coupled to the second electrode of the driving transistor, a second electrode of the fifth transistor is electrically coupled to the third node, and a control electrode of the fifth transistor is electrically coupled to a light emitting control signal terminal; a first electrode of the sixth transistor is electrically coupled to a common electrode terminal, a second electrode of the sixth transistor is electrically coupled to the second node, and a control electrode of the sixth transistor is electrically coupled to the light emitting control signal terminal, and wherein the driving method comprises a reset stage, a compensation stage and a light emitting stage, wherein in the reset stage, controlling the first transistor, the second transistor and the third transistor to be turned on, controlling the fourth transistor, the fifth transistor, the sixth transistor and the driving transistor to be turned off, the voltage of the first node is reset to Vinit, and the voltage of the second node is Vdata; where, Vinit is the initialization voltage, and Vdata is the data voltage;

in the compensation stage, controlling the first transistor, the second transistor and the fourth transistor to be turned on, and controlling the third transistor, the fifth transistor, the sixth transistor and the driving transistor to be turned off, so that the voltage of the first node is equal to Vf+V0, the voltage of the second node is equal to Vdata and the voltage of the third node is equal to Vf+V0; where Vf is the lighting voltage of the light emitting diode, and V0 is the voltage of the second power supply terminal;

in the light emitting stage, controlling the driving transistor, the fifth transistor and the sixth transistor to be turned on, and controlling the first transistor, the second transistor, the third transistor and the fourth transistor to be turned off, so that the voltage of the first node is equal to Vcom−Vdata+Vf+V0, the voltage of the second node is equal to Vcom, and the voltage of the third node is equal to Vcom−Vdata+Vf+V0−Vth; where Vcom is the common voltage, and Vth is a threshold voltage of the driving transistor.

* * * * *